US005419463A

United States Patent [19]

Mizushima et al.

[11] Patent Number: 5,419,463

[45] Date of Patent: May 30, 1995

[54] LIQUID SPRAYER

[75] Inventors: Hiroshi Mizushima; Tadao Saito, both of Tokyo, Japan

[73] Assignee: Yoshino Kogyosho Co.. Ltd., Tokyo, Japan

[21] Appl. No.: 721,611

[22] PCT Filed: Oct. 5, 1990

[86] PCT No.: PCT/JP90/01297

§ 371 Date: Oct. 1, 1990

§ 102(e) Date: Oct. 1, 1990

[87] PCT Pub. No.: WO92/05879

PCT Pub. Date: Apr. 16, 1992

[51] Int. Cl.[6] ..... B65D 88/54

[52] U.S. Cl. ..... 222/321.3; 222/340; 222/341

[58] Field of Search ..... 222/321, 340, 341, 383, 222/385

[56] References Cited

U.S. PATENT DOCUMENTS 3,471,065 10/1969 Malone ..... 222/340 X
3,797,748 3/1974 Nozawa et al. ..... 222/340 X
4,147,286 4/1979 Spatz ..... 222/340 X
4,174,055 11/1979 Capra et al. ..... 222/340 X

FOREIGN PATENT DOCUMENTS 2380076 10/1978 France ..... 222/341

*Primary Examiner*—Andres Kashnikow
*Assistant Examiner*—Kenneth Bomberg
*Attorney, Agent, or Firm*—Oliff & Berridge

[57] ABSTRACT

The present invention has its object, the provision of a liquid sprayer capable of spraying a long time and a simple construction with respect to liquid sprayers having a cylinder and a piston. In order to accomplish this object, the liquid sprayer according to the present invention is constructed so as to have a long piston stroke, and has an operating member up- and downwards slidably located on the container body having a cylinder, a stem hung from this operating member and fitted into the cylinder, a trunk-like piston being provided at the lower end of the stem sliding in the cylinder together with the up- and downward movements of the operating member, a spring provided in the interior of the cylinder and energizing said piston and said stem downwards, a depressing spraying head provided on the operating member, and a discharge valve provided in the interior of the operating member and communicating the stem with the depressing spraying head together with the depression of the depressing spraying head.

3 Claims, 7 Drawing Sheets

LIQUID SPRAYER

FIELD OF THE ART

The present invention relates to a liquid sprayer wherein liquid cosmetic or liquid is discharged therefrom in a straight line of in a sprayed pattern.

BACKGROUND OF THE INVENTION

As an atomizer for spraying liquid continuously, an aerosol-type liquid sprayer using fleon gas is often used. In such an aerosol-type liquid sprayer, fleon gas is pressurized in a container body, and by depressing the head of an upper end of a valve tube which is erected in an energized condition from an aerosol-type valve locked in the head portion of the container, the aerosol-type valve is opened, thereby spraying the liquid in the container body out of a spraying aperture through the valve and the valve tube.

The aerosol-type liquid sprayer is very convenient because pressurized liquid is sprayed out of the opened valve only by depressing the valve tube of the aerosol-type valve. When fleon gas used for pressurization, however, is discharged in the atmosphere, it rises up to an ultra-high altitude and destroys the ozone layer, so that the development of a manual liquid sprayer capable of spraying continuously without using fleon gas is expected.

Speaking of liquid sprayers in general, an accumulator atomizer as disclosed in Utility Model Laid Open No. 185475/88 is often used. In this accumulator atomizer, by energizing upwards and erecting a tubular member with its lower end provided with a small diameter trunk piston from a small diameter cylinder provided with a suction valve hanging into the container body, by fitting a large diameter trunk piston provided at the upper end of this member into a large diameter cylinder hanging from the lower surface of a depressing head, by forming a discharge valve of a valve body erecting from the upper end of the member and a valve hole drilled in the top wall of the large diameter cylinder, and by depressing said depressing head with respect to the container body, said tubular member is lowered against energization because of pressurization in the large diameter cylinder, thereby opening the discharge valve, and the liquid is sprayed out of the atomizer having an opening in the side face of the depressing head, and because of cancellation of the pressurization the tubular member and the depressing head are raised by said energization with the suction valve being closed when the depressing head is released, thereby opening the suction valve, and the liquid in the container body is sucked into the both cylinders and the tubular member.

Such a conventional accumulator atomizer is capable of spraying liquid for a short period of time so that it is necessary to depress the head many times to obtain a required amount of liquid out of the atmizer, which takes a great deal of effort. However, there are no alternative products to replace a conventional accumulator atomizer. Moreover, the construction thereof is also complicated.

The present invention made under these circumstances has as its object the provision of an atomizer which is capable of spraying liquid for a long period of time and is constructed simple.

DISCLOSURE OF THE INVENTION

The present invention relates to a liquid sprayer comprising a container body having a neck portion; a cylinder hanging from said neck portion into the container body; a suction valve provided at the lower end portion of this cylinder; a suction pipe hanging from the lower portion of the cylinder; an operating member up- and downwards movably located on the container body; a stem hanging from this operating member and being inserted into said cylinder: a trunk piston provided at the lower end of the stem and sliding together with the up- or downwards moving operating member in the cylinder; a spring provided in the cylinder and energizing said trunk piston and stem downwards: a depressing spraying head provided on the operating member: and a discharge valve provided in the operating member, communicating said stem with the depressing spraying head with said depressing spraying head being depressed.

In this liquid sprayer, spraying liquid is stored in the container body and the operating member is lifted up at first against the spring. Thus, the trunk piston is raised, thereby generating a negative pressure in the interior of the cylinder, and sucking the liquid in the container body via the suction pipe and the suction valve into the cylinder. When the lifted up operating member is released in this condition, the trunk piston will be lowered due to the elasticity of the spring, thereby pressurizing the liquid in the cylinder. When the depressing spraying head is depressed by depressing the operating member, the discharge valve is opened, thereby allowing the pressurized liquid to flow from the stem into the spraying head and out of the spraying nozzle of this spraying head. According to the sprayed amount, the container body is raised by the energizing force of the spring, and is finally returned to the original position thereof.

As said discharge valve, an aerosol-type valve is preferably used, having a valve tube connected to said head and being opened when the stem and the piston are depressed by depressing the head.

The aerosol-type valve comprises preferably a valve body having upper and lower opened ends; an elastic member having a first through-hole sealing an upper surface of the valve body; a casing having a second through-hole and connecting the elastic member and the valve body to each other in one-piece construction by enveloping them therein; a valve tube having a closed lower end and an opened upper end to which said head is connected, and also having at the middle portion thereof an annular concave part with a valve hole drilled, the lower end thereof being inserted through the second through-hole of the casing and the first through-hole of the elastic member into the valve body and the elastic member being fitted into said annular concave part; and a spring energizing this valve tube upwards.

The casing may be formed of a metallic sheet such as aluminum. A plastic casing, however, is preferably fitted onto the upper portion of said valve body.

In addition, by providing the operating member with a grip trunk up- and downwards slidably fitted onto the container body, an easier operation is possible, and since the operating member is guided up- and downwards by the grip trunk, the operating member, and thus, the piston are more stably moved up- and downwards, and longer up- and downward strokes of the piston are realized.

BRIEF DESCRIPTION OF THE DRAWINGS

FIG. 1 is a half sectional front view,

FIG. 2 is a half sectional view wherein the liquid sprayer is in an operated condition, FIG. 3 is an enlarged sectional view of the discharge valve portion.

FIG. 5 is a longitudinal sectional view of the liquid sprayer,

FIG. 6 is a longitudinal sectional view wherein liquid has been sucked into the cylinder, and FIG. 7 is a sectional view of the aerosol-type valve member used in the liquid sprayer.

FIG. 8 is a half sectional front view of the operating member, FIG. 9 is a half sectional view of the discharge valve portion, and FIG. 10 is a view illustrating one variation of the piston portion.

PREFERRED EMBODIMENTS OF THE INVENTION

Figure 1:
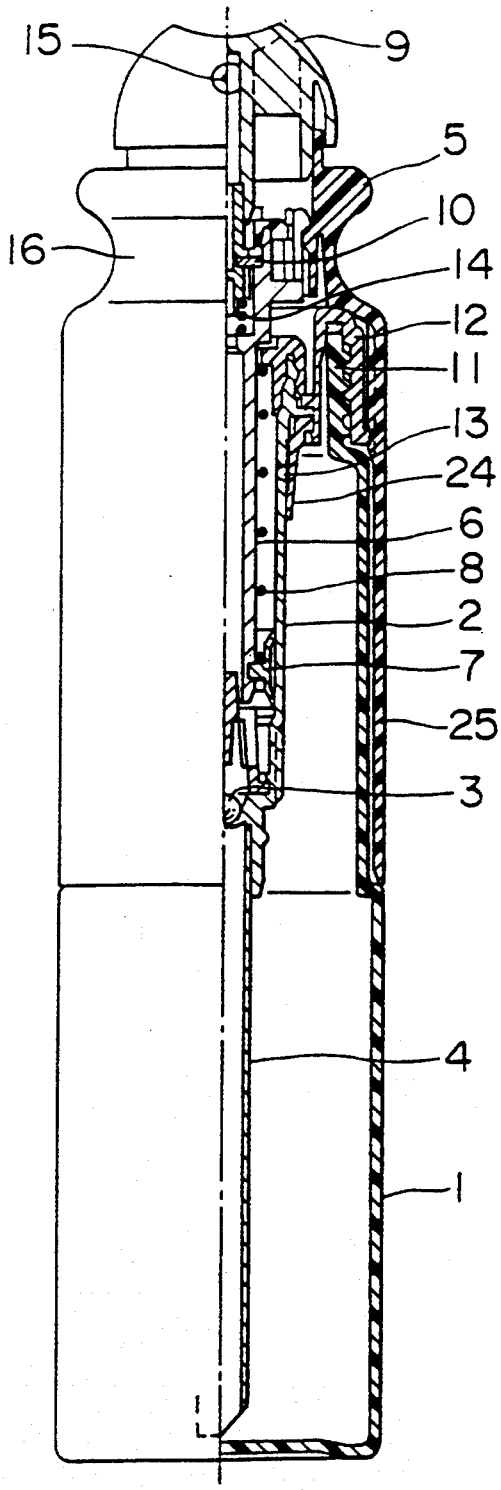
FIGS. 1 to 3 illustrate Example 1 of the present invention.

Referring now to the drawings, the preferred embodiments of the present invention will be described in the following:

[EXAMPLE 1]

As illustrated in FIGS. 1 to 4, an attaching trunk 12 is threaded on the neck portion 11 of the container body 1 forming a wide-mounted and long bottle, the upper end of a cylinder 2 is secured to this attaching trunk by fitting the former into the latter, and this cylinder 2 is hung from the neck portion into the container body 1.

The cylinder 2 is provided with a suction valve 3 comprising a ball valve in the interior of the lower portion thereof, a suction pipe 4 hanging from the lower end thereof, and an air suction hole 13 on the exterior of the upper portion thereof introducing outside air into the container body 1 in order to prevent a negative pressure. This air suction hole 13 is covered with an elastic trunk-like portion 24 for preventing the leakage of liquid.

A trunk-like operating member 5 is up- and downwards slidably provided on the upper portion of the container body 1 or the exterior of the attaching trunk 12, the upper end of a stem 6 is fitted into and engaged with an upper middle portion of this operating member located on the attaching trunk 12, and a spring 8 is provided in the interior of the cylinder 2, thereby energizing a trunk-like piston 7 and the stem 6 downwards. In addition, a grip trunk 25 is hung, being fitted onto the container body 1 so as to envelop the upper half of the container body 1 from the periphery of the operating member 5 therein.

Figure 2:
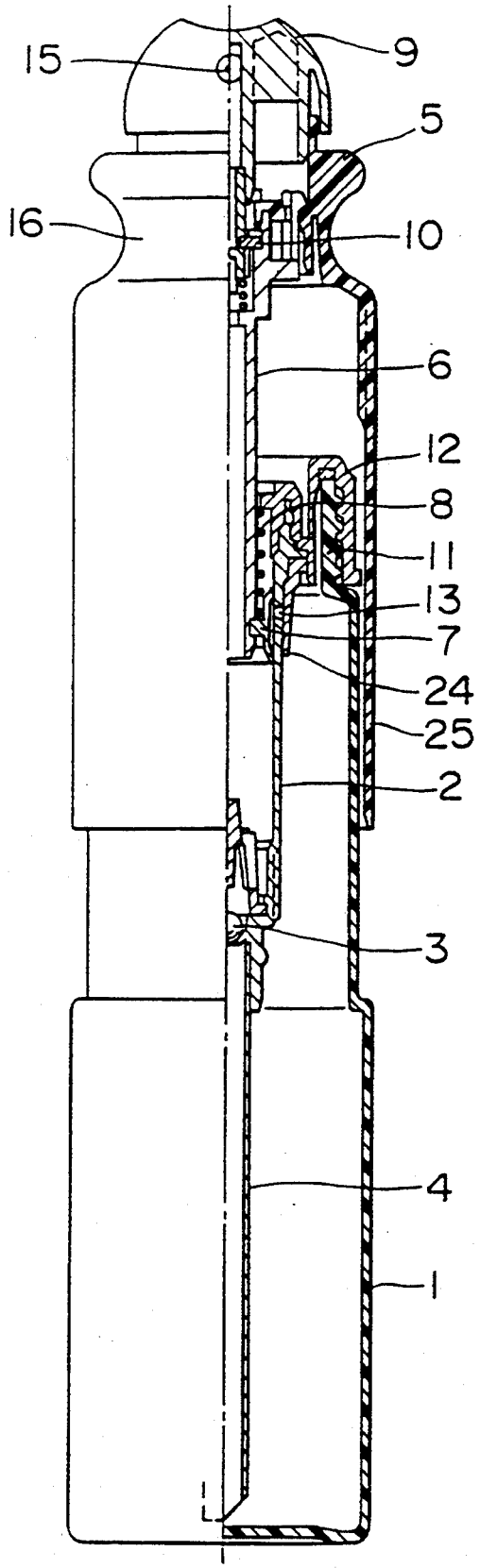
Figure 3:
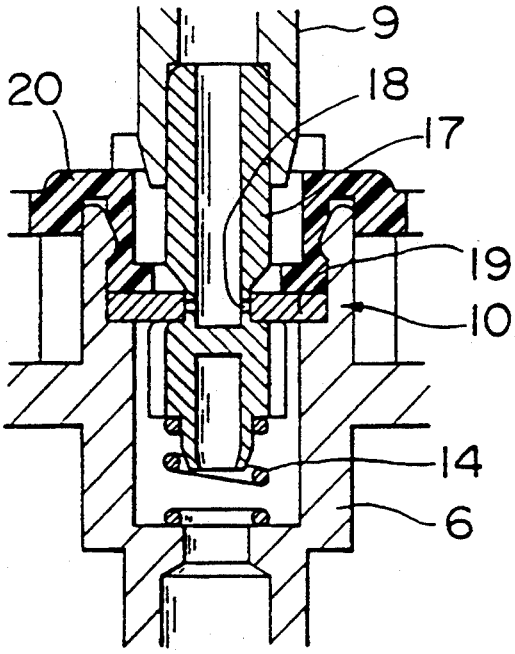

In FIGS. 1 and 2, 16 is a finger-hold concave part provided around the upper outer periphery of the operating member 5.

A depressing spraying head 9 is depression-slidably attached to the upper end of the operating member 5, and in the interior of the upper portion of the operating member 5 is provided a discharge valve 10 being connected mechanically to the depressing spraying head 9 and communicating said head 9 with said stem 6 together with the depression of said head 9, and further, in the interior of the upper portion of stem 6 is provided a spring 14 energizing the depressing spraying head 9 upwards simultaneously with the discharge valve 10 being pushed up in a closed condition. In the figures, 15 is a spraying nozzle provided on the front side of the depressing spraying head 9. The spraying nozzle 15 is one of the type spraying liquid-like mist.

Figure 4:
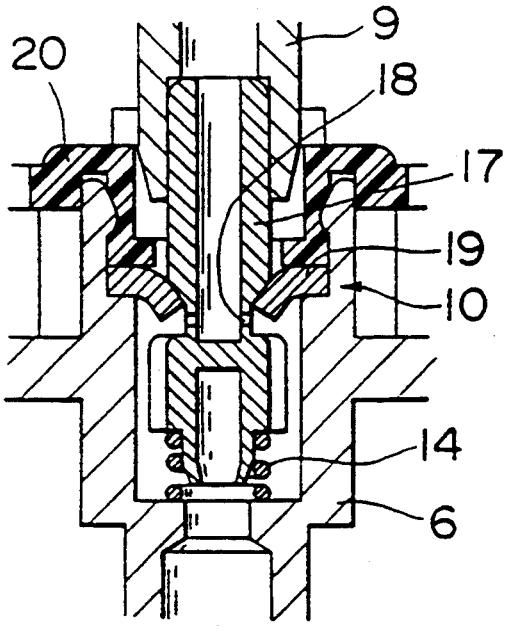
FIG. 4 is an enlarged sectional view wherein the discharge valve is in an operated condition.

The discharge valve 10 has a bottomed valve tube 17 fitted into the lower end of the depressing spraying head 9. An annular concave part is provided in the middle portion of this valve tube 17, and a valve hole 18 is drilled in this annular concave part. And a collar-like elastic member 19 having a first through-hole is located at the upper end of the stem 6, a casing 20 having a second through-hole is fitted onto the upper end of the stem, and the elastic member 19 is secured thereto. The valve tube 17 is inserted through the second through-hole of the casing 20 and the first hole of the elastic member 19 into the stem 6, the elastic member 19 is fitted into the annular concave part of the valve tube, and said valve hole 18 is sealed by means of the inner peripheral surface of the elastic body 19. In addition, the bottomed valve tube 17 is energized upwards by means of spring 14 thereby maintaining the valve-sealing condition of the elastic member 19. Together with the lowered depressing spraying head 9, as illustrated in FIG. 4, the bottomed valve tube 17 is lowered, thereby opening the valve hole 18. In the illustrated example, the elastic member 19 is deformed when the valve is opened, but an elastic member opening the valve by sliding may be also used.

In this example, only by lifting up the operating member with respect to the container body 1 or by depressing the container body 1 with respect to the operating member 5, liquid can be pressurized by means of the Spring 8, and thereafter this pressurized liquid can be sprayed in an atomized pattern only by depressing the depressing spraying head 9.

A grip trunk 25 is hung from the operating member 5, and since grip trunk 25 is up- and downwards slidably fitted into the container body 1 and the stem 6 has a trunk-like piston 7, the operating member 5 will not be loose with respect to the cylinder 2 when spraying liquid, even if the stroke of the trunk-like piston 7 with respect to the cylinder 2 becomes large, thereby realizing a smooth spraying.

In addition, since the liquid Sprayer in this example is constructed so as to raise the container body 1 with respect to the operating member 5, there are no problems of complicated spraying operations due to too large a stroke.

And opposed to sprayers using fleon gas, this sprayer is friendly to the environment, is easy to operate, has a simple mechanism against the mechanical complication of the conventional accumulator sprayers, and is practically Very useful and convenient.

EXAMPLE 23

Figure 5:
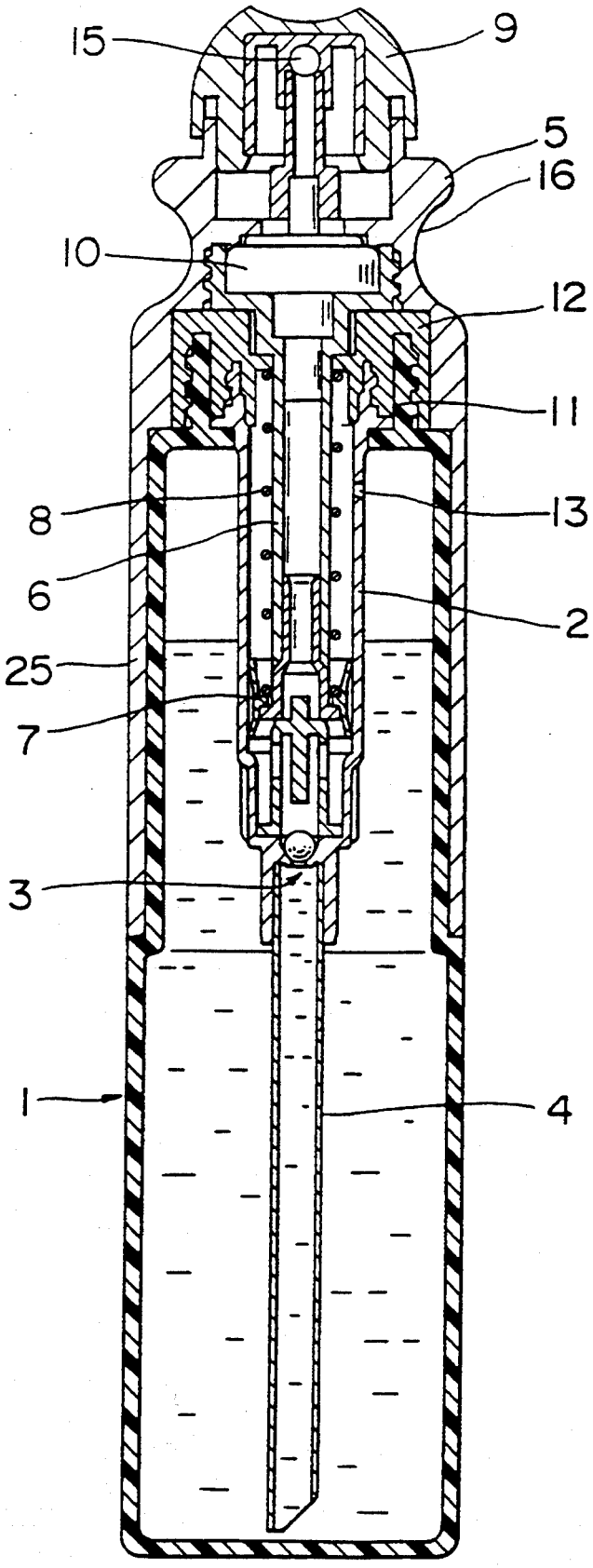
FIGS. 5 to 7 illustrate Example 2 of the present invention.
Figure 6:
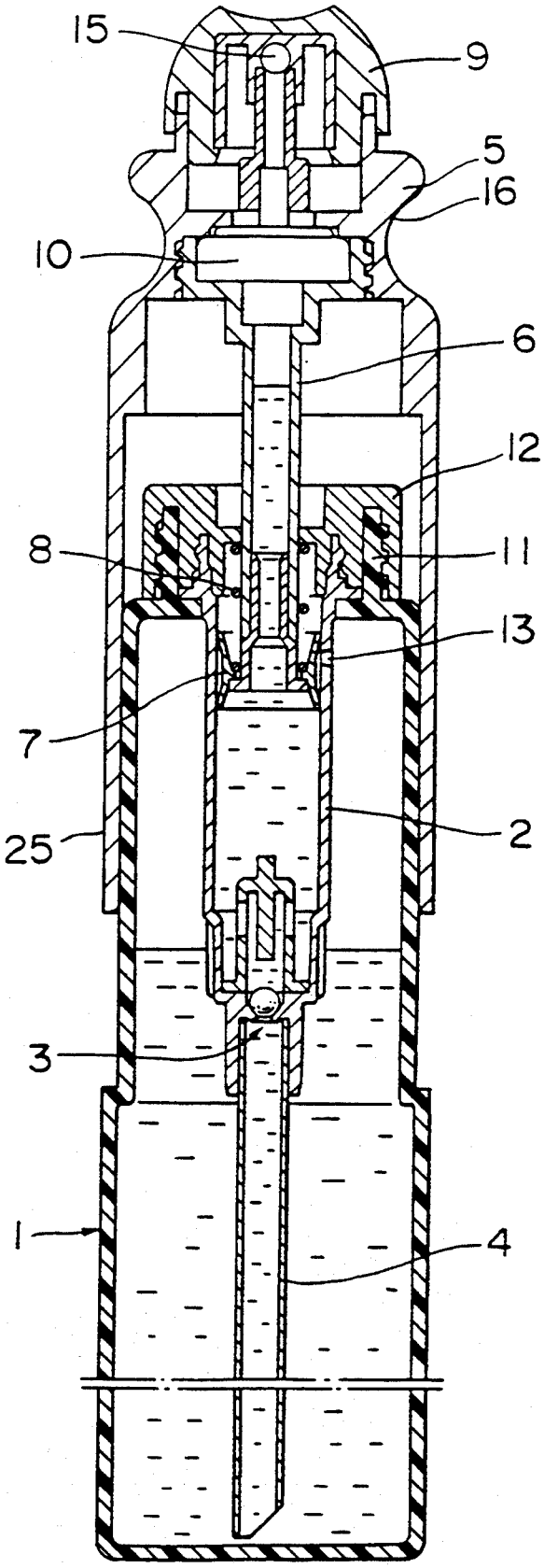
Figure 7:
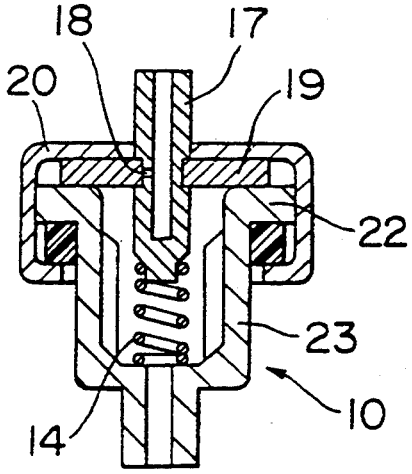

As illustrated in FIGS. 5 to 7, Example 2 has essentially a similar arrangement as Example 1 except for partial design changes. The discharge valve 10 is different from Example 1 in that an independent aerosol-type valve is incorporated. Also the elastic trunk-like portion 24 is omitted.

That is, the cylinder 2 is hung into the neck portion 11 and the upper portion of the cylinder 2 is secured to the neck portion 11 by means of the attaching trunk 12.

At the upper portion of the stem whose lower end is inserted into the cylinder 2, an aerosol-type cylinder 10 is provided on, passing through the attaching trunk 12.

In one example illustrated in FIG. 7, a valve body 23 having an outward flange 22 and an elastic member 19 having a first through-hole and sealing the upper surface of the valve body 23 are enveloped in a metallic casing 20 having a second through-hole, and are connected to each other in one-piece construction, and at the same time a valve tube 17 with a closed lower end surface having an annular concave part with a valve hole 18 at the middle portion thereof is inserted into the second through-hole of said casing 20 and the first through-hole of said elastic member 19, the elastic member 19 is fitted into the annular concave pant, the valve hole 18 is sealed by means of the inner wall surface of the first through-hole of elastic member 19, the valve tube 17 is energized upwards by means of a spring 14, and a valve is formed of the valve hole 18 and the elastic body 19. When a head 9 with a spraying aperture 15 is fitted into the upper end of the valve tube 17, and the head 9 is depressed against energization, the peripheral portion of the first through-hole of the elastic member 19 is bent downwards due to the lowered valve tube 17, thereby opening the valve hole 18, and when the valve tube 17 is raised due to the interruption of depression, the elastic member 19 is also elastically returned to the illustrated position, thereby sealing said valve hole 18.

In case of an aerosol-type liquid sprayer, the upper end of an outflow pipe is fitted into the trunk portion 29 hanging from the inner periphery of the inward flange-like bottom wall of the valve body 23, and the outflow pipe is hung into the container body, while the outflow pipe is not required in this example.

Since this example is similar to Example 1 in other points, the description of the similar points are omitted with the same symbols being affixed.

[EXAMPLE 3]

Figure 8:
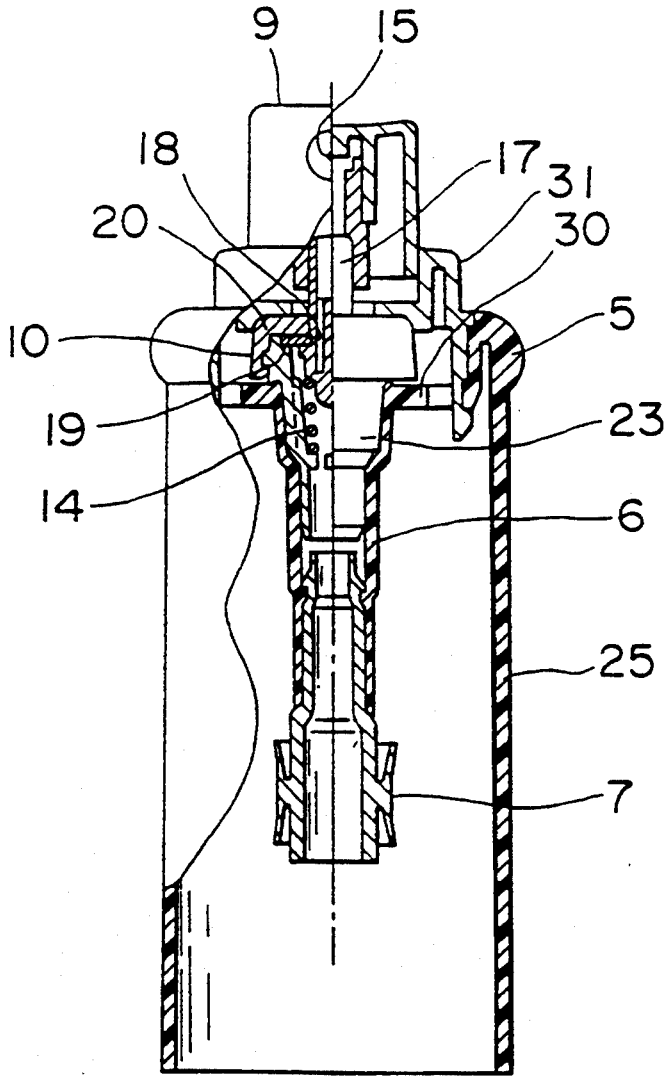
FIGS. 8 to 10 illustrate Example 3.
Figure 9:
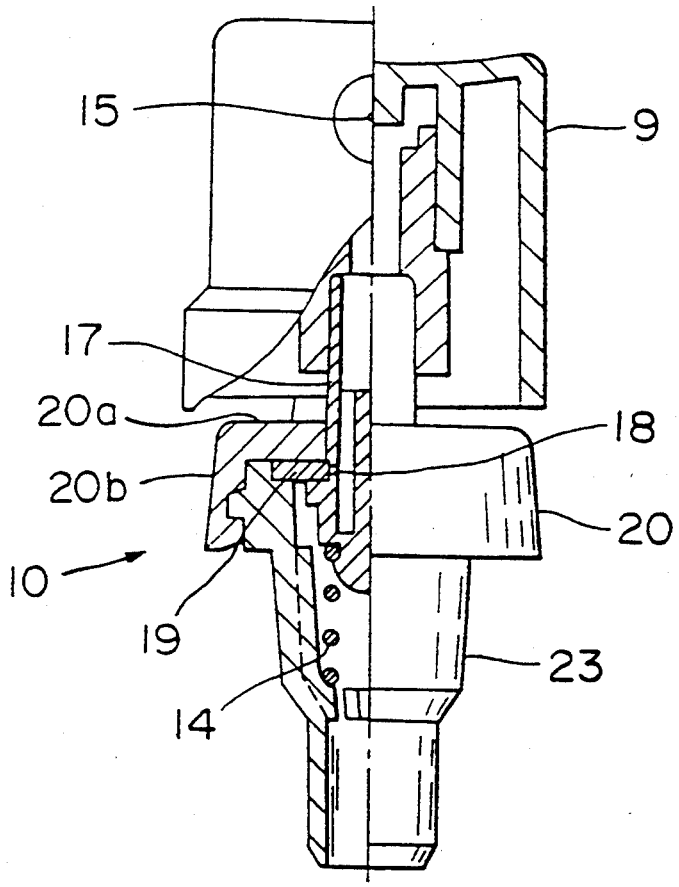

As illustrated in FIGS. 8 and 9, Example 3 uses a different aerosol-type valve from that in Example 2. In this example, the stem 6 and the grip trunk 25 are constructed in one-piece by means of a connecting piece 30, thereby decreasing the number of the component parts. The aerosol-type valve is an engaging trunk, the tip of which is inserted in an engaging hole provided in said connecting piece 80 and engaged therein. This engaging trunk 31 is secured on the connecting piece As for the aerosol-type valve used in Example 3, a trunk-like valve body 23, the upper half of which being of larger diameter than the lower half, and an elastic member 19 with a first through-hole sealing the upper surface of the valve body 23 are enveloped in a plastic casing 20 having a second through-hole, and are connected to each other in one-piece construction. That is, the plastic casing 20 is constructed so as to erect a side wall portion **20*b* around a top plate portion 20*a* having the second through-hole in the middle and to provide a concave groove in the interior of the side wall portion 20*b*, and it is fitted into the trunk-like valve body 23 by fitting a convex groove provided on the upper outer periphery of the trunk-like valve body 23 into this concave groove. A valve tube 17 with a closed lower end surface having an annular concave part valve hole 18 drilled at the middle portion thereof is inserted through the second through-hole of said plastic casing 20 and the first through-hole of said elastic member 19, the elastic member 19 is fitted into the annular concave part, said valve hole 18 is sealed by means of the inner wall surface of the first through-hole of the elastic member 19, and the valve tube 17 is energized upwards by means of a spring 14 provided in the trunk-like valve body 23. Thus, a discharge valve is formed of the valve hole 18 and the elastic member 19. When a head 9 with a spraying aperture 15 is fitted into the upper end of the valve tube 17, and the head 9 is depressed against energization, the peripheral portion of the first through-hole of the elastic member 19 is bent downwards due to the lowered valve tube 17, thereby opening the valve hole 18, and when the valve tube 17 is raised due to the interruption of depression, the elastic member 19 is also elastically returned to the illustrated position, thereby sealing said valve hole 18. Unlike the valve in Example 2 using a metallic casing, the valve in this Example uses a plastic casing, thus allowing the casing 20 to be fitted onto the valve body 23** much more easily than in Example 2 wherein the metallic casing is fixed by caulking.

Figure 10:
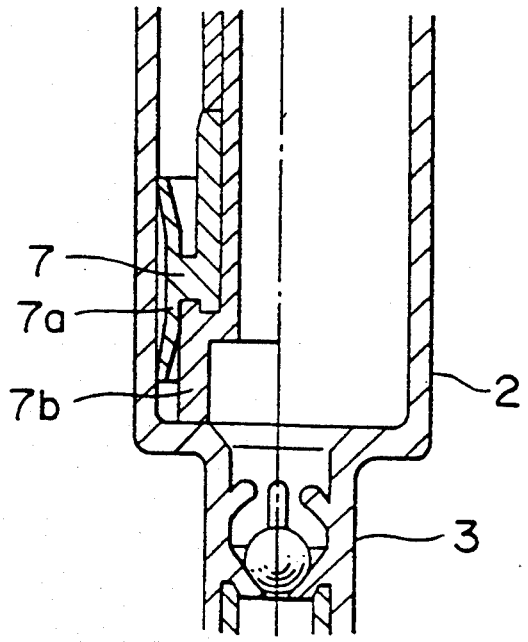

As illustrated in FIG. 10, by separating the main portion of the piston from the trunk portion **7*b*, the main portion of the piston may only be replaced with the trunk portion 7b remaining unreplaced, even if the cylinder 2** has a different diameter, which is very economical.

[EXAMPLE 4]

Figure 11:
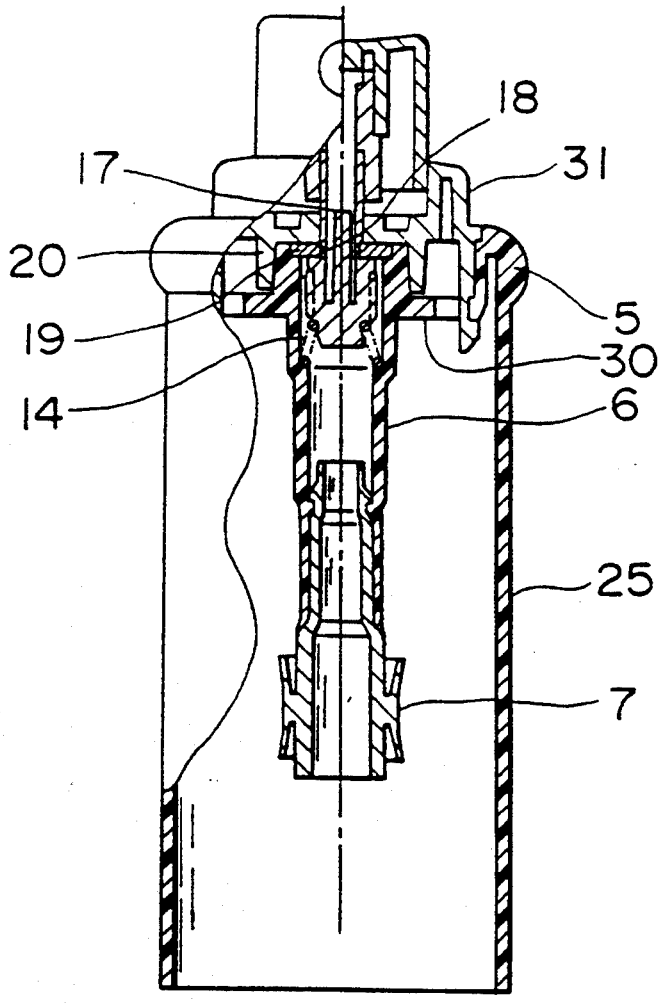
FIG. 11 illustrates Example 4 and is a half sectional view of an operating member.

In this example, as illustrated in FIG. 11, the aerosol-type valve of Example 3 is incorporated in the stem 6, wherein the trunk-like valve body is constructed as a member forming a portion of the stem 6 in one-piece, the plastic casing 20 constructed together with an engaging trunk 31 in one-piece is fitted onto the stem 6, the plastic casing 20 is fitted onto the stem 6, the elastic member 19 with a first through-hole is provided at the upper portion of the stem 6, the valve tube 17 with a closed lower end surface having an annular concave portion with a valve hole 18 drilled is inserted through the second through-hole of said plastic casing 20 and the first through-hole of said elastic member 19, the elastic member 19 is fitted into the annular concave part, said valve hole is sealed by means of the inner wall surface of the first through-hole of the elastic member 19, and the valve tube 17 is energized upwards by means of the spring 14 engaging a stepped part provided in the stem 6. Since said plastic casing 20 is constructed in one-piece with said engaging trunk 31 and a tip of trunk 31 is inserted into an engaging hole provided in said connecting piece 30 and engaged therein, the number of component parts is decreased.

In this arrangement, an easier mass production and a decreased production cost can be realized.

[Other Examples]

Every component part of the above-described apparatus can be molded of plastic. According to the designs of spraying apertures, atomizers spraying liquid in an atomized pattern or sprayers spraying liquid in a straight-line can be provided.

Industrial Applications

The present invention is applicable for atomizing or spraying various liquids, for example, as atomizers for cosmetic liquids, sprayers for shampoo liquids, atomizers for insecticides, atomizers for liquid detergents, etc.

We claim:

1. A liquid sprayer comprising a container body having a neck portion;

a cylinder hanging from said neck portion into the container body having a longitudinal axis;

a suction valve provided at a lower end portion of the cylinder;

an operating member longitudinally movably located on the container body;

a stem hanging from the operating member and being inserted into said cylinder;

a trunk piston provided at a lower end of the stem and sliding together with the longitudinally moving operating member in the cylinder;

a spring provided in the cylinder and energizing said trunk piston and stem downwards;

a depressing spraying head provided on the operating member; and a discharge valve provided in the operating member and communicating said stem with the depressing spraying head with said depressing spraying head being depressed;

said trunk piston comprising a main portion sliding in sealing engagement with an inner wall surface of said cylinder, and a trunk portion secured in a lower end portion of said stem;

said main portion and said trunk portion being formed of separate pieces and said main portion being removably located on said trunk portion.

2. A liquid sprayer comprising a container body having a neck portion;

a cylinder hanging from said neck portion into the container body having a longitudinal axis;

a suction valve provided at a lower end portion of the cylinder;

a suction pipe hanging from the lower end portion of the cylinder;

an operating member longitudinally movably located on the container body;

a stem hanging from the operating member and being inserted into said cylinder;

a trunk piston provided at the lower end of the stem and sliding together with the longitudinally moving operating member in the cylinder;

a spring provided in the cylinder and energizing said trunk piston and stem downwards;

a depressing spraying head provided on the operating member; and a discharge valve provided in the operating member and communicating said stem with the depressing spraying head with said depressing spraying head being depressed;

said stem and operating member being connected to form one-piece by means of a connecting piece having an engaging hole;

an engaging trunk having a plurality of engaging legs that stretch downward from a bottom of the engaging trunk, a tip of each said engaging leg being inserted in said engaging hole of said connecting piece;

said discharge valve being located between a bottom of said engaging trunk and said connecting piece and fixed on said connecting piece so that a valve hole of said discharge valve may be connected with an upper end portion of said stem and with said connecting piece.

3. A liquid sprayer comprising a container body having a neck portion;

a cylinder hanging from said neck portion into the container body having a longitudinal axis;

a suction valve provided at a lower end portion of the cylinder;

an operating member longitudinally movably located on the container body;

a stem hanging from the operating member and being inserted into said cylinder;

a trunk piston provided at the lower end of the stem and sliding together with the longitudinally moving operating member in the cylinder;

a spring provided in the cylinder and energizing said trunk piston and stem downwards;

a depressing spraying head provided on the operating member;

a discharge valve provided in the operating member and communicating said stem with the depressing spraying head with said depressing spraying head being depressed;

an air suction hole connected with the container body and formed on an upper end portion of said cylinder; and an elastic trunk-like portion provided on an exterior of the upper portion of said cylinder, said elastic trunk-like portion covering said air suction hole;

said elastic trunk-like portion permitting air in said cylinder to enter said container body only when said trunk piston moves upward by said operating member pulling up said stem; and said elastic trunk-like portion covering said air suction hole by sticking to an exterior of the upper portion of said cylinder in order to prevent leakage of liquid in said container body by said cylinder.

* * * * *